US010526818B2

(12) United States Patent
Rosales et al.

(10) Patent No.: US 10,526,818 B2
(45) Date of Patent: Jan. 7, 2020

(54) MOTOR VEHICLE LOCK

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US); Stepan Hanke, Lake Orion, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 823 days.

(21) Appl. No.: 15/053,140

(22) Filed: Feb. 25, 2016

(65) Prior Publication Data

US 2016/0258193 A1 Sep. 8, 2016

Related U.S. Application Data

(60) Provisional application No. 62/129,552, filed on Mar. 6, 2015.

(51) Int. Cl.
*E05B 81/16* (2014.01)
*E05B 77/06* (2014.01)
(Continued)

(52) U.S. Cl.
CPC ..... *E05B 77/06* (2013.01); *E05B 77/12* (2013.01); *E05B 77/02* (2013.01); *Y10S 292/22* (2013.01)

(58) Field of Classification Search
CPC ..... E05B 77/02; E05B 77/04; E05B 77/06; Y10S 292/22
See application file for complete search history.

(56) References Cited

U.S. PATENT DOCUMENTS 5,865,481 A * 2/1999 Buschmann ..... E05B 77/06 292/169.11
7,607,702 B2 * 10/2009 Pereverzev ..... E05B 77/06 292/201

(Continued)

FOREIGN PATENT DOCUMENTS

DE 19511651 A1 * 10/1995 ..... E05B 77/06
DE 19738492 A1 * 3/1998 ..... E05B 77/06

(Continued)

OTHER PUBLICATIONS

European Search Report for European Patent Application No. 16158701.9 dated Aug. 22, 2016 (7 pages).

*Primary Examiner* — Carlos Lugo
(74) *Attorney, Agent, or Firm* — Pauly, DeVries Smith & Deffner LLC

(57) ABSTRACT

The application is directed to a motor vehicle lock for a door arrangement, wherein the catch may be brought into holding engagement with a lock striker, wherein the pawl may be brought into an engagement position, wherein the pawl may be deflected into a release position, wherein an actuation lever is provided for deflecting the pawl, wherein a switchable lock arrangement is in an actuation drive train between the actuation lever and the pawl, wherein the switchable lock arrangement may be brought into a functional state, wherein, with the switchable lock arrangement being in the unlocked state, an actuation movement of the actuation lever deflects the pawl and a drive train component of the actuation drive train is decoupled from the pawl for letting the actuation movement of the actuation lever run free or a drive train component is blocked for blocking an actuation movement of the actuation lever.

19 Claims, 5 Drawing Sheets

(51) Int. Cl.
*E05B 77/12* (2014.01)
*E05B 77/02* (2014.01)

(56) References Cited

U.S. PATENT DOCUMENTS

| | | | | |
|---|---|---|---|---|
| 8,056,944 | B2 * | 11/2011 | Jankowski | E05B 77/06 292/201 |
| 9,410,345 | B2 * | 8/2016 | Uehara | E05B 77/06 |
| 9,528,301 | B2 * | 12/2016 | Bendel | E05B 85/26 |
| 9,534,424 | B2 | 1/2017 | Bendel et al. | |
| 10,132,106 | B2 | 11/2018 | Rosales | |
| 2011/0181052 | A1 | 7/2011 | Brose et al. | |
| 2014/0292005 | A1 * | 10/2014 | Bendel | E05B 77/06 292/336.3 |
| 2016/0258194 | A1 * | 9/2016 | Rosales | E05B 77/06 |

FOREIGN PATENT DOCUMENTS

| | | | | |
|---|---|---|---|---|
| DE | 19912682 | A1 * | 9/2000 | E05B 77/04 |
| DE | 10011563 | A1 * | 10/2001 | E05B 77/02 |
| DE | 102004008048 | A1 * | 9/2005 | E05B 77/06 |
| DE | 102009058751 | A1 * | 5/2011 | E05B 77/06 |
| DE | 202011003549 | U1 * | 6/2012 | E05B 77/04 |
| DE | 102014001123 | A1 * | 7/2015 | E05B 77/06 |
| FR | 2970680 | A1 * | 7/2012 | E05B 77/04 |
| WO | WO-2012055387 | A2 * | 5/2012 | E05B 77/06 |
| WO | 2014071908 | | 5/2014 | |

* cited by examiner

MOTOR VEHICLE LOCK

CLAIM OF PRIORITY

This application claims the benefit of U.S. Provisional Application No. 62/129,552, filed Mar. 6, 2015, the content of which is herein incorporated by reference in its entirety.

FIELD OF THE TECHNOLOGY

The application is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

Crash safety plays an important role for today's motor vehicle locks. It is of particular importance that neither crash induced acceleration nor crash induced deformation leads to an unintended opening of the motor vehicle door to which the motor vehicle lock is assigned. The focus of the present application is to prevent an unintended opening of the motor vehicle door based on crash induced acceleration. In case of a side impact on the motor vehicle the outer door handle may be reluctant to follow the impact due to mass inertia of the outer door handle. As a result, a relative movement between the outer door handle and the motor vehicle door occurs, which again may lead to an unintended opening of the motor vehicle door.

The known motor vehicle lock (US 2011/0181052 A1), which is the starting point for the invention, is provided with the usual locking elements catch and pawl, wherein the pawl may be deflected into a release position by actuation of an actuation lever. The pawl may be deflected into its released position by an outer door handle which is connected to the actuation lever, if the lock mechanism is in its unlocked state. With the lock mechanism being in its locked state an actuation of the actuation lever runs free.

To guarantee a high crash safety the known motor vehicle lock comprises a crash element which is a separate component from the actuation lever. By the accelerations which occur during a crash the crash element moves into a blocking position in which the crash element blocks further actuation of the actuation lever.

One disadvantage of the known motor vehicle lock and particularly of its crash safety behavior is the observation that the crash element only reaches its blocking position in the case of a crash. Accordingly, there is no guarantee that during the lifetime of the motor vehicle that there does not evolve some obstruction that prevents the crash element from reaching its blocking position during a crash. Therefore the crash safety of the known motor vehicle lock may be improved.

SUMMARY

It is the object of the invention to improve the known motor vehicle lock in a cost-effective way such that its crash safety is improved.

The above noted object is solved for a motor vehicle lock according to the embodiments described herein.

The general idea is to switch the switchable lock arrangement in every single case during an actuation of the actuation lever into the locked state. This improves the crash safety as the locked state is the state into which the switchable lock arrangement is to be brought during a crash. In normal operation, the switchable lock arrangement returns to the unlocked state during actuation of the actuation lever such that the pawl is deflected. In a predetermined crash condition the switchable lock arrangement remains in the locked state such that the pawl is not deflected. With the proposed solution, the probability of the switchable lock arrangement not being able to enter the locked state during a crash is considerably reduced.

According to an embodiment the crash condition goes back on a crash induced movement of the actuation lever, in particular of the outer actuation lever. As it is mostly the outer actuation lever, which performs an unintended crash induced movement, this embodiment is of particular importance.

The proposed return of the switchable lock arrangement has to be synchronized with the actuation of the actuation lever, such that during normal use the actuation of the actuation lever is not affected and that during a crash condition the actuation of the actuation lever is disabled.

An embodiment is directed to a solution in which the switchable lock arrangement is a central lock arrangement. The double use of the central lock arrangement leads to a compact structure.

Various embodiments are directed to a construction in which the switchable lock arrangement comprises a locking lever which rotational position determines the locking state of the switchable lock arrangement. According to various embodiments, an inertial lever is arranged between the actuation lever and the locking lever, which, depending on the rapidity of the actuation lever, moves the locking lever into an overtravel region. With this, the necessary delay of the return to the unlocked state may be realized with particular low constructional effort.

An embodiment provides a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein an actuation lever is provided for deflecting the pawl into the release position, wherein a switchable lock arrangement is provided in an actuation drive train between the actuation lever and the pawl, wherein the switchable lock arrangement may be brought into one of a plurality of functional states, which functional states comprise a "locked state" and an "unlocked state", wherein, with the switchable lock arrangement being in the unlocked state, an actuation movement of the actuation lever deflects the pawl and, with the switchable lock arrangement being in the locked state, a drive train component of the actuation drive train is decoupled from the pawl for letting the actuation movement of the actuation lever run free without deflecting the pawl or a drive train component is blocked for blocking an actuation movement of the actuation lever, wherein an actuation of the actuation lever during the unlocked state switches the switchable lock arrangement to the locked state, that the switchable lock arrangement remains in the locked state such that the pawl is not deflected on a predetermined crash condition and that otherwise the switchable lock arrangement returns to the unlocked state such that the pawl is deflected and that otherwise the switchable lock arrangement returns to the unlocked state such that the pawl is deflected.

In an embodiment, the predetermined crash condition is based on a rapidity threshold with regard to the actuation movement of the actuation lever, in particular the outer actuation lever.

In an embodiment, wherein after being switched to the locked state on actuation of the actuation lever during the unlocked state, the switchable lock arrangement is configured, can be pre-stressed, to return to the unlocked state automatically after a return time, in particular, wherein the return time is based on inertial characteristics of the switchable lock arrangement, and in some embodiments, the return time is based on a rapidity of an actuation movement of the actuation lever.

In an embodiment, the switchable lock arrangement is a user-switchable lock arrangement, such as a central lock arrangement.

In an embodiment, a position, in particular a rotational position, of a locking lever of the switchable lock arrangement determines the functional state of the switchable lock arrangement and that the locking lever is pre-stressed toward an unlocked position corresponding to the unlocked state of the switchable lock arrangement, and in some embodiments the locking lever is configured to assume a locked position corresponding to the locked state of the switchable lock arrangement.

In an embodiment, the switchable lock arrangement is switched to the locked state on the predetermined crash condition by engaging the locking lever and moving it to the locked position.

In an embodiment, the locking lever can be moved to an overtravel region, that the switchable lock arrangement is in the locked state when the locking lever is in the overtravel region and that movement of the locking lever from the unlocked position to the overtravel region is an extension of the movement from the unlocked position to the locked position.

In an embodiment, the extent of movement of the locking lever into the overtravel region from the unlocked position is based on, and can be substantially proportional to, the rapidity of the actuation movement of the actuation lever.

In an embodiment, the motor vehicle lock comprises an inertial lever for switching the switchable lock arrangement to the locked state, and can be for engaging the locking lever on actuation of the actuation lever.

In an embodiment, the actuation movement begins from an actuation lever start position and that the actuation lever is configured to engage the inertial lever from the actuation lever start position and carry the inertial lever until an inertial lever release position of the actuation lever, such that the inertial lever release position is prior to completion of the actuation movement.

In an embodiment, the inertial lever is configured to engage the switchable lock arrangement, in particular the locking lever, for switching the switchable lock arrangement to the locked state, at least until the inertial lever release position is reached.

In an embodiment, the inertial lever is configured to engage the switchable lock arrangement, in particular the locking lever, for delaying the return to the unlocked state after reaching the inertial lever release position at least for a delay engagement time.

In an embodiment, the motor vehicle lock comprises a guiding contour for keeping the actuation lever engaged to the inertial lever until the inertial lever release position and that the inertial lever is pre-stressed, such as spring-biased, for being released from the actuation lever on reaching the inertial lever release position.

In an embodiment, the inertial lever is pre-stressed, such as spring-biased, for returning to an initial position of the inertial lever, wherein the actuation lever in the actuation lever start position is configured to engage the inertial lever in the initial position.

BRIEF DESCRIPTION OF THE FIGURES

In the following the invention will be described in an example referring to the drawings. In the drawings it is shown in FIG. 1 the relevant parts of a proposed motor vehicle lock in a top view with the actuation lever in an unactivated state, FIG. 2 the motor vehicle lock according to FIG. 1 during normal use with the actuation lever being in the inertial lever release position, FIG. 3 the motor vehicle lock according to FIG. 1 during normal use with the actuation lever having passed the inertial lever release position, FIG. 4 the motor vehicle lock according to FIG. 1 during normal use with the actuation lever and inertial lever returning to their initial positions, FIG. 5 the motor vehicle lock according to FIG. 3 during a crash condition with the actuation lever having passed the inertial lever release position.

DETAILED DESCRIPTION

Figure 1:
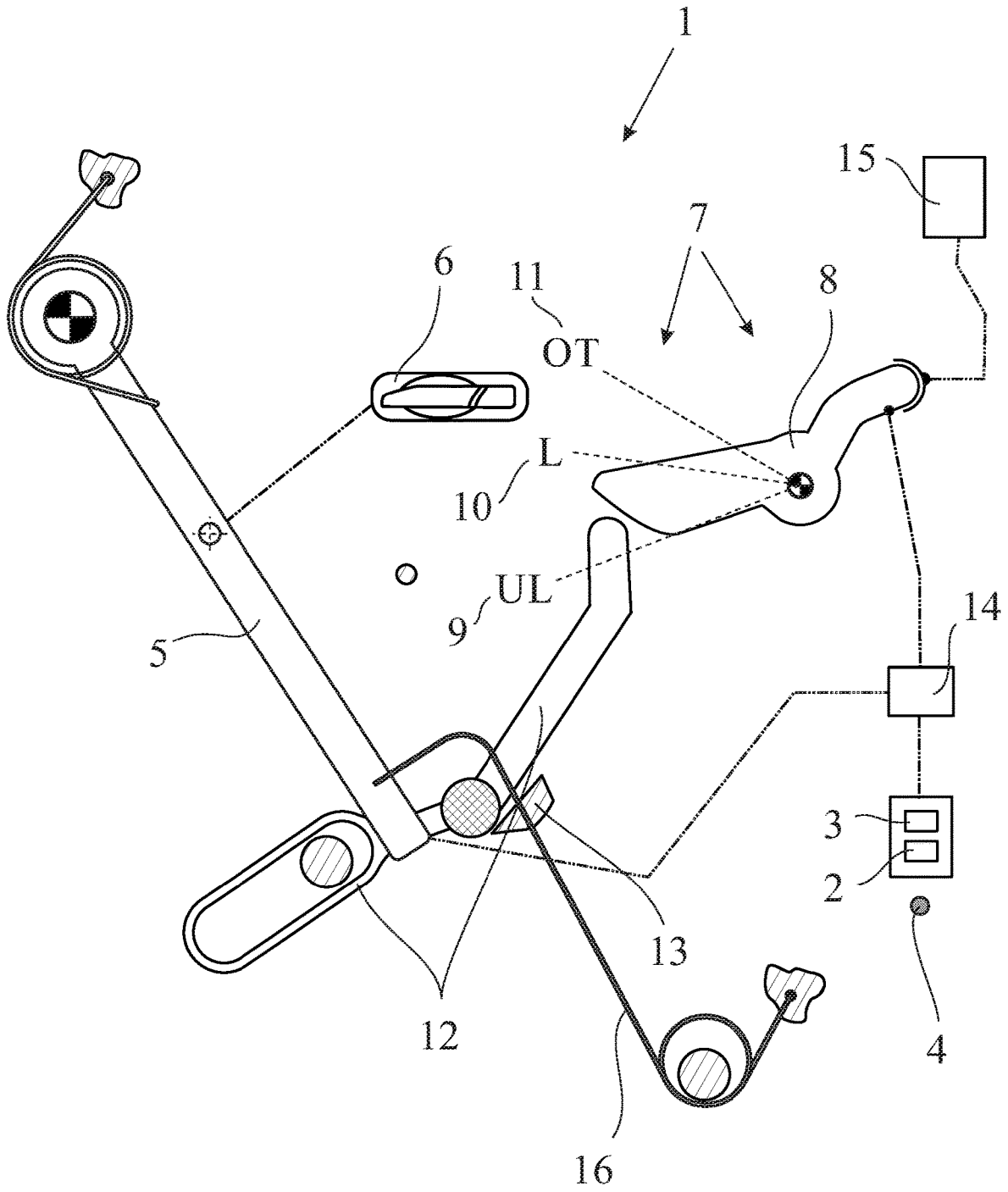

The motor vehicle lock 1 shown in the drawings is assigned to a motor vehicle door arrangement, which comprises a motor vehicle door (not shown) beside said motor vehicle lock 1. Regarding the broad interpretation of the expression "motor vehicle door" reference is made to the introductory part of the specification. Here the motor vehicle door is a side door of a motor vehicle.

The motor vehicle lock 1 comprises the usual locking elements catch 2 and pawl 3, which pawl 3 is assigned to the catch 2. The catch 2 and the pawl 3 are shown only schematically in the drawings. The catch 2 can be brought into an open position and into a closed position. In the closed position the catch 2 is or may be brought into holding engagement with a lock striker 4 that is indicated in the drawings. The motor vehicle lock 1 is normally arranged at or in the motor vehicle door, while the lock striker 4 is arranged at the motor vehicle body.

Figure 2:
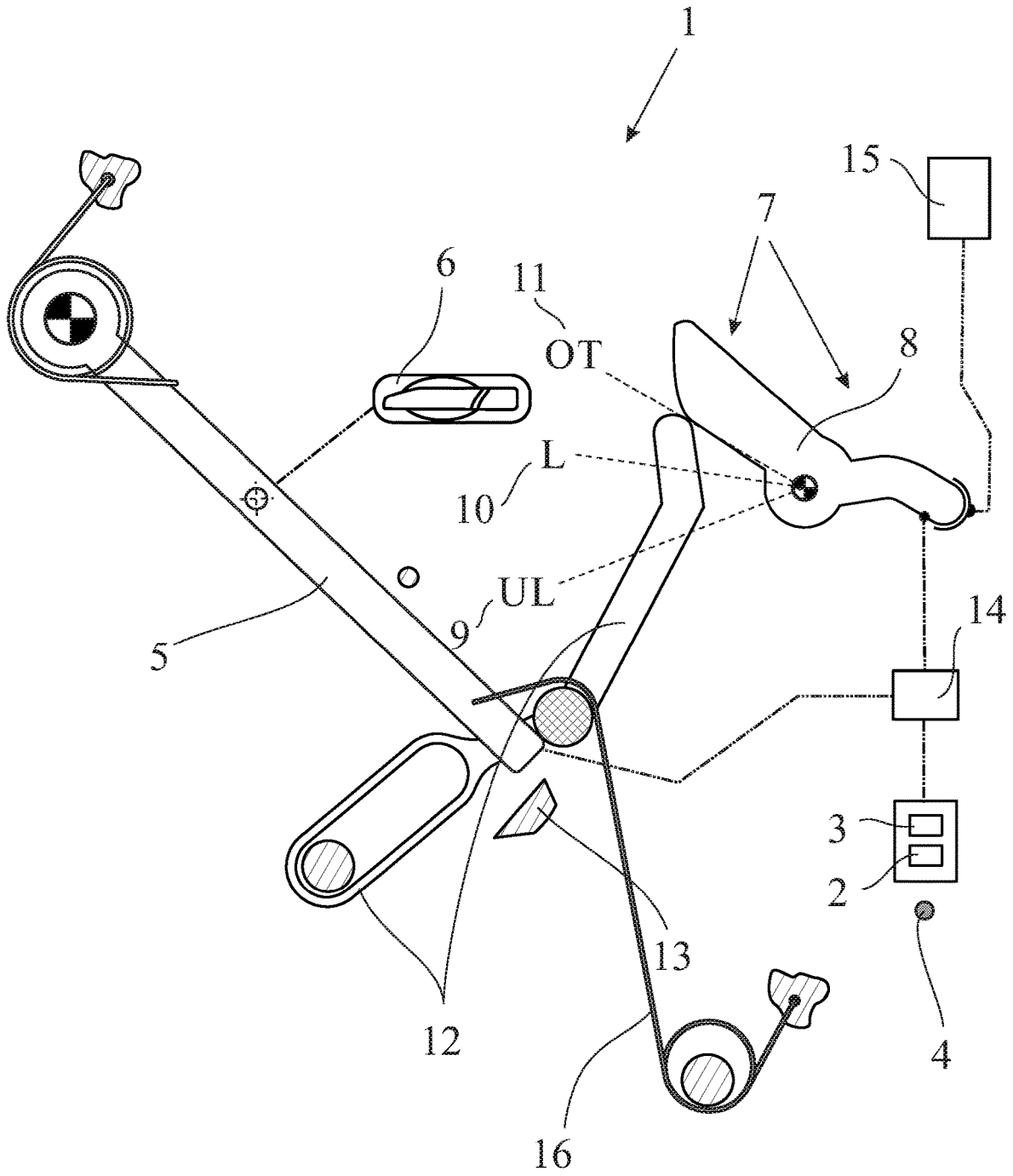
Figure 3:
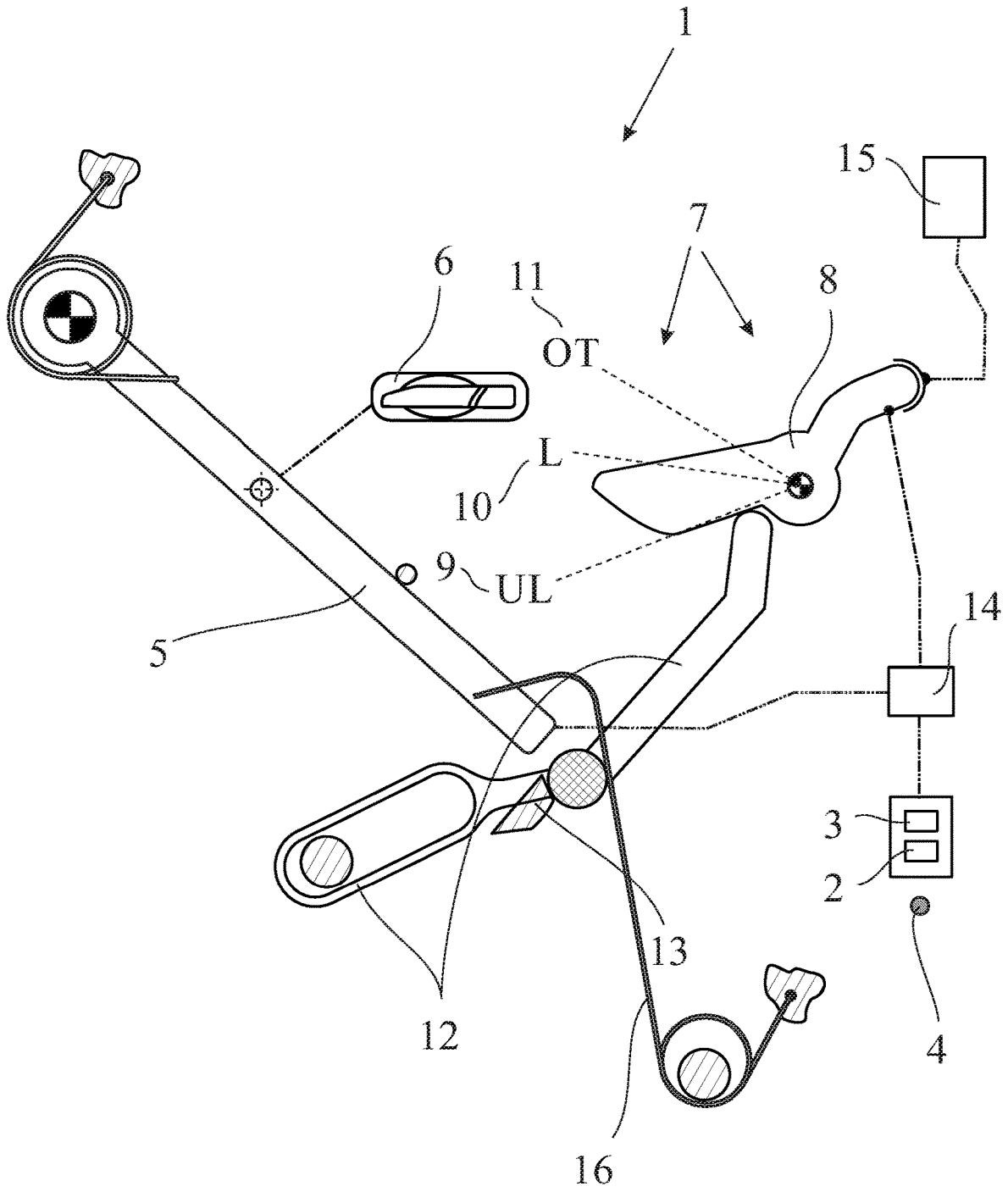

The pawl 3 may be brought into an engagement position shown in FIGS. 1 and 3, in which it is in blocking engagement with the catch 2. Here the pawl 3 blocks the catch 2 in its closed position in a mechanically stable manner such that the pawl 3 itself does not have to be blocked. For release of the catch 2 into its open position the pawl 3 may be deflected into a release position shown in FIG. 2, which would be a deflection in the anti-clockwise direction from the situation in FIG. 1.

An actuation lever 5 is provided for deflecting the pawl 3 into the release position. The actuation lever 5 may engage the pawl 3 for deflection either directly or—as in the present embodiment—indirectly. The actuation lever 5 may be coupled to a door handle 6, such as to an outer door handle, such that the assigned motor vehicle door may be opened by actuating the door handle 6. Thus, the actuation lever 5 may be understood to be an outer release lever.

Further, a switchable lock arrangement 7 is provided in an actuation drive train between the actuation lever 5 and the pawl 3. In this actuation drive train between the actuation lever 5 and the pawl 3, any number of elements such as levers may be provided. It may also be that the actuation drive train consists of the actuation lever 5 and the pawl 3 themselves.

The switchable lock arrangement 7 may be brought into a locked state and into an unlocked state, wherein the locked state and the unlocked state of the switchable lock arrangement 7 are stable. These states, comprising the locked state and the unlocked state, may also be called "functional states". That the states are stable means that, when the switchable lock arrangement 7 is either in the locked state or in the unlocked state, it remains stable in the respective state out of its own accord until further actuation. In an embodiment, the switchable lock arrangement 7 may be brought into any number of further such functional states such as "double-locked", "theft-protected" or "child-locked".

When for the motor vehicle lock 1 according to the proposal the switchable lock arrangement 7 is in the above unlocked state, an actuation movement of the actuation lever 5 deflects the pawl 3. On the other hand, when the switchable lock arrangement 7 is in the above locked state, a drive train component of the actuation drive train is decoupled from the pawl 3 for letting the actuation movement of the actuation lever 5 run free without deflecting the pawl 3 or a drive train component 8 is blocked for blocking an actuation movement of the actuation lever 5. Therefore, the locked state in the present sense may refer to any or all of the functional states "central locked", "double locked" or "theft-protected", i.e. to all functional states in which a deflection of the pawl by actuation of the outer door handle is prevented.

According to the proposal, an actuation of the actuation lever 5 during the unlocked state switches the switchable lock arrangement 7 to the locked state, which is shown in the sequence of FIG. 1 and FIG. 2 during normal use. The same applies to a crash induced movement of the actuation lever 5.

The switchable lock arrangement 7 remains in the locked state such that the pawl 3 is not deflected on a predetermined crash condition (FIG. 5) and that otherwise the switchable lock arrangement 7 returns to the unlocked state such that the pawl 3 is deflected. During normal use, however, the switchable lock arrangement 7 returns to the unlocked state such that the pawl 3 is deflected (FIG. 3).

Here, the predetermined crash condition is based on a rapidity threshold with regard to the actuation movement of the actuation lever 5, which can be an outer actuation lever, as will be explained in further detail as well.

After being switched to the locked state on actuation of the actuation lever 5 during the unlocked state, the switchable lock arrangement 7 is configured, such as pre-stressed, to return to the unlocked state automatically after a return time. This return time may be based on inertial characteristics of the switchable lock arrangement 7, and, in some embodiments, on a rapidity of an actuation movement of the actuation lever 5.

In order to make the double use of components possible, in an embodiment, the switchable lock arrangement 7 is a user-switchable lock arrangement and further in some embodiments a central lock arrangement.

The drawings show a locking lever 8, which here is rotationally moveable. A position, in particular a rotational position, of the locking lever 8 of the switchable lock arrangement 7 determines the functional state of the switchable lock arrangement 7, wherein the locking lever 8 is pre-stressed toward an unlocked position 9 corresponding to the unlocked state of the switchable lock arrangement 7 (FIG. 1), in some embodiments, wherein the locking lever 8 is configured to assume a locked position 10 corresponding to the locked state of the switchable lock arrangement 7 (FIG. 5).

Figure 5:
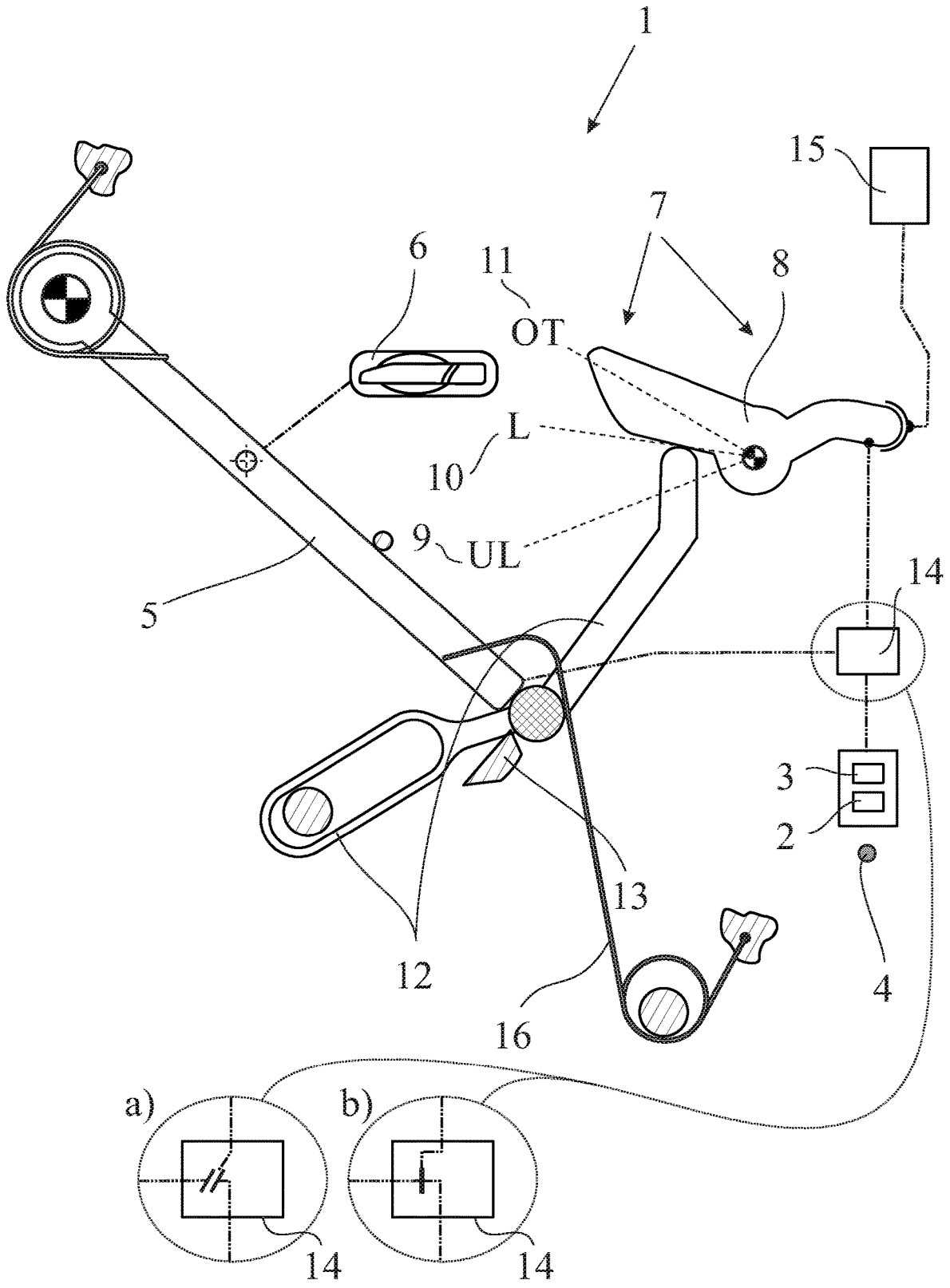
FIG. 5*a* shows a drive train component of the actuation drive train decoupled from the pawl and FIG. 5*b* shows a drive train component is blocked.

On the predetermined crash condition, the switchable lock arrangement 7 is switched to the locked state as shown in FIG. 5 by engaging the locking lever 8 and moving it to the locked position 10.

As shown in FIG. 2, the locking lever 8 can be moved to an overtravel region 11, wherein the switchable lock arrangement 7 is in the locked state when the locking lever 8 is in the overtravel region 11 and that movement of the locking lever 8 from the unlocked position 9 to the overtravel region 11 is an extension of the movement from the unlocked position 9 to the locked position 10.

The extent of movement of the locking lever 8 into the overtravel region 11 from the unlocked position 9 is based on, can be substantially proportional to, the rapidity of the actuation movement of the actuation lever 5. This may be derived from FIG. 2 taking into account in particular the inertial characteristics of the locking lever 8.

The motor vehicle lock 1 also comprises an inertial lever 12 for switching the switchable lock arrangement 7 to the locked state. Here the inertial lever 12 serves for engaging the locking lever 8 on actuation of the actuation lever 5.

In both normal use and crash condition, the actuation movement begins from an actuation lever start position (FIG. 1), wherein the actuation lever is configured to engage the inertial lever 12 from the actuation lever start position and carry the inertial lever 12 until an inertial lever release position of the actuation lever 5. Here that the inertial lever release position is prior to completion of the actuation movement.

FIG. 2 shows, that the inertial lever 12 is configured to engage the switchable lock arrangement 7, in particular the locking lever 8, for switching the switchable lock arrangement 7 to the locked state, at least until the inertial lever release position is reached.

In particular, the inertial lever 12 is configured to engage the switchable lock arrangement 7, here the locking lever 8, for delaying the return to the unlocked state after reaching the inertial lever release position at least for a delay engagement time. This situation is shown in FIG. 3 for the normal use and in FIG. 5 for the crash condition.

According to an embodiment shown in the drawings a guiding contour 13 is provided for keeping the actuation lever 5 engaged to the inertial lever 12 until the inertial lever release position is reached and that the inertial lever 12 is pre-stressed, such as spring-based, for being released from the actuation lever 5 on reaching the inertial lever release position. This release of the inertial lever 12 from the actuation lever 5 is shown in FIG. 3 for normal use and in FIG. 5 for a crash condition.

Figure 4:
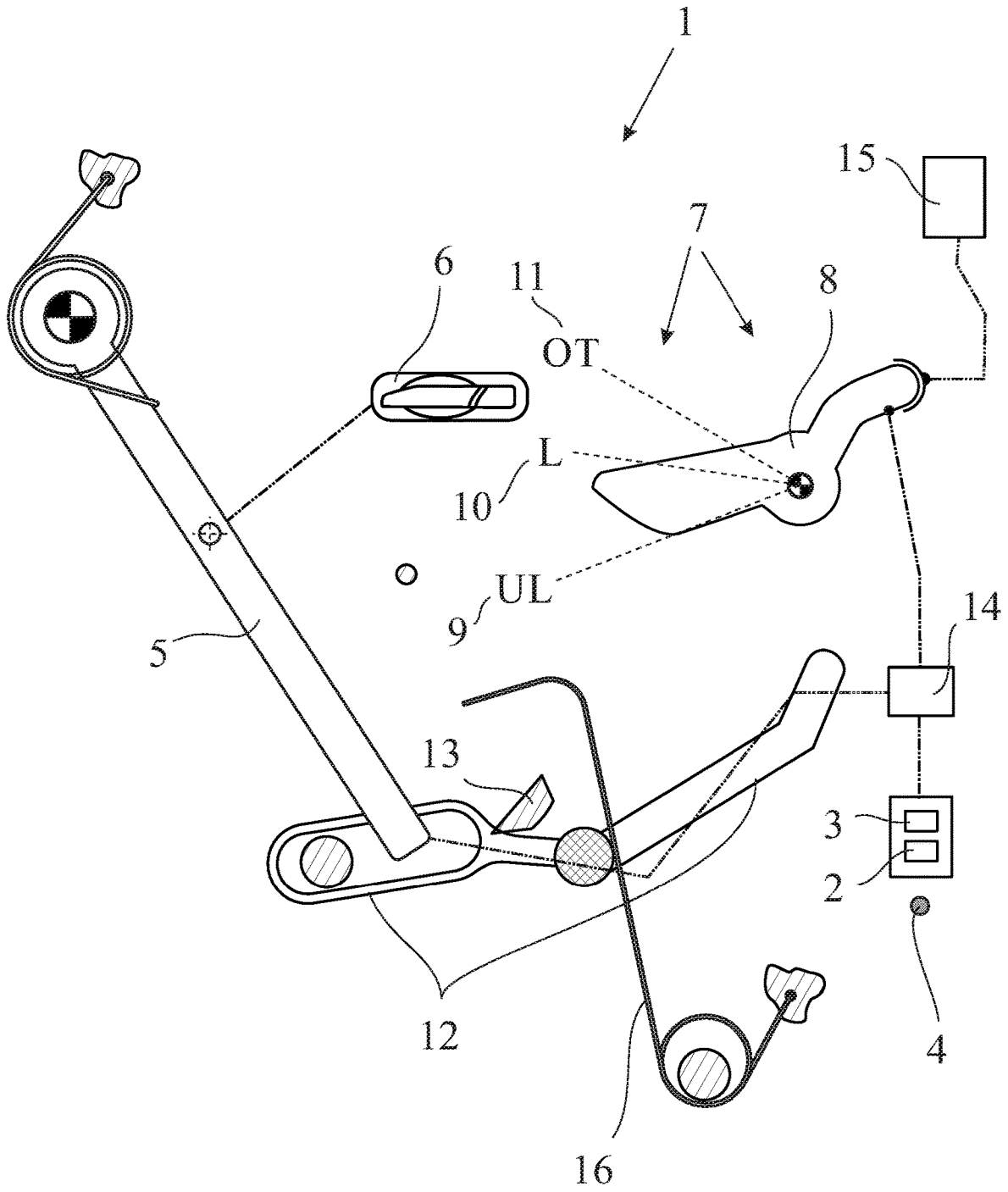

Further, the inertial lever 12 can be pre-stressed, such as spring-biased, for returning to an initial position of the inertial lever 12, wherein the actuation lever 5 in the actuation lever start position is configured to engage the inertial lever 12 in the initial position. This spring bias is realized by a spring arrangement 16 shown in the drawings. The spring biased return of the inertial lever 12 is shown in FIG. 4.

It is to be noted that the locking lever 8 in the embodiment shown in the drawings is acting on a coupling arrangement 14, which coupling arrangement 14 realizes the coupling respective decoupling of the actuation lever 5 with respective from the pawl 3. It is finally to be noted that the locking lever 8 may in addition be driveable by a central locking drive 15, as is shown in the drawings as well. In an embodiment, this central locking drive 15 realizes a user-actuated switching between the locked state and the unlocked state.

FIG. 5*a* shows a state where a drive train component of the actuation drive train is decoupled from the pawl (3) for letting the actuation movement of the actuation lever (5) run free without deflecting the pawl (3). FIG. 5*b* shows a state where a drive train component is blocked for blocking an actuation movement of the actuation lever (5).

The invention claimed is:

1. A motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein an actuation lever is provided for deflecting the pawl into the release position, wherein an actuation drive train is located between the actuation lever and the pawl to transmit movement of the actuation lever to the pawl, wherein a coupling arrangement is located within the actuation drive train, wherein a switchable lock arrangement is operatively connected to the coupling arrangement, wherein the switchable lock arrangement may be brought into one of a plurality of functional states, which functional states comprise a "locked state" and an "unlocked state", wherein, with the switchable lock arrangement being in the unlocked state, an actuation movement of the actuation lever deflects the pawl and, with the switchable lock arrangement moved into the locked state, the connection between the switchable lock arrangement and the coupling arrangement will decouple the coupling arrangement from the pawl for letting the actuation movement of the actuation lever run free without deflecting the pawl or the coupling arrangement will be blocked for blocking an actuation movement of the actuation lever, wherein an actuation of the actuation lever during the unlocked state is configured to act on an inertia lever which switches the switchable lock arrangement to the locked state, that the switchable lock arrangement remains in the locked state such that the pawl is not deflected on a predetermined crash condition and that otherwise the switchable lock arrangement returns to the unlocked state such that the pawl is deflected, wherein the motor vehicle lock comprises the inertial lever for switching the switchable lock arrangement to the locked state.

2. The motor vehicle lock according to claim 1, wherein the predetermined crash condition is based on a rapidity threshold with regard to the actuation movement of the actuation lever, in particular the outer actuation lever.

3. The motor vehicle lock according to claim 1, wherein after being switched to the locked state on actuation of the actuation lever during the unlocked state, the switchable lock arrangement is configured to return to the unlocked state automatically after a return time.

4. The motor vehicle lock according to claim 3, wherein the return time is based on inertial characteristics of the switchable lock arrangement.

5. The motor vehicle lock according to claim 3, wherein the return time is based on a rapidity of an actuation movement of the actuation lever.

6. The motor vehicle lock according to claim 1, wherein the switchable lock arrangement is a user-switchable lock arrangement.

7. The motor vehicle lock according to claim 1, wherein a position of a locking lever of the switchable lock arrangement determines the functional state of the switchable lock arrangement and that the locking lever is pre-stressed toward an unlocked position corresponding to the unlocked state of the switchable lock arrangement.

8. The motor vehicle lock according to claim 7, wherein the switchable lock arrangement is switched to the locked state on the predetermined crash condition by engaging the locking lever and moving it to the locked position.

9. The motor vehicle lock according to claim 7, wherein the locking lever can be moved to an overtravel region, that the switchable lock arrangement is in the locked state when the locking lever is in the overtravel region and that movement of the locking lever from the unlocked position to the overtravel region is an extension of the movement from the unlocked position to the locked position.

10. The motor vehicle lock according to claim 7, wherein the extent of movement of the locking lever into the overtravel region from the unlocked position is based on the rapidity of the actuation movement of the actuation lever.

11. The motor vehicle lock according to claim 7, wherein the locking lever is configured to assume a locked position corresponding to the locked state of the switchable lock arrangement.

12. The motor vehicle lock according to claim 1, wherein the actuation movement begins from an actuation lever start position and that the actuation lever is configured to engage the inertial lever from the actuation lever start position and carry the inertial lever until an inertial lever release position of the actuation lever.

13. The motor vehicle lock according to claim 12, wherein the inertial lever is configured to engage the switchable lock arrangement for switching the switchable lock arrangement to the locked state, at least until the inertial lever release position is reached.

14. The motor vehicle lock according to claim 12, wherein the inertial lever is configured to engage the switchable lock arrangement for delaying the return to the unlocked state after reaching the inertial lever release position at least for a delay engagement time.

15. The motor vehicle lock according to claim 12, wherein the motor vehicle lock comprises a guiding contour for keeping the actuation lever engaged to the inertial lever until the inertial lever release position and that the inertial lever is pre-stressed for being released from the actuation lever on reaching the inertial lever release position.

16. The motor vehicle lock according to claim 15, wherein the inertial lever is spring-biased.

17. The motor vehicle lock according to claim 12, wherein the inertial lever is pre-stressed for returning to an initial position of the inertial lever, wherein the actuation lever in the actuation lever start position is configured to engage the inertial lever in the initial position.

18. The motor vehicle lock according to claim 12, wherein the inertial lever release position is prior to completion of the actuation movement.

19. The motor vehicle lock according to claim 1, wherein the motor vehicle lock comprises an inertial lever for engaging the locking lever on actuation of the actuation lever.

* * * * *